US010995747B2

(12) United States Patent
Rawlings

(10) Patent No.: US 10,995,747 B2
(45) Date of Patent: May 4, 2021

(54) MECHANISM FOR FINE ADJUSTMENT OF FLOWS IN FIXED DISPLACEMENT PUMP

(71) Applicant: Fluid Metering, Inc., Syosset, NY (US)

(72) Inventor: David Lionel Rawlings, Sound Beach, NY (US)

(73) Assignee: FLUID METERING, INC., Syosset, NY (US)

( * ) Notice: Subject to any disclaimer, the term of this patent is extended or adjusted under 35 U.S.C. 154(b) by 674 days.

(21) Appl. No.: 15/027,870

(22) PCT Filed: Dec. 12, 2014

(86) PCT No.: PCT/US2014/069903
§ 371 (c)(1),
(2) Date: Apr. 7, 2016

(87) PCT Pub. No.: WO2015/089355
PCT Pub. Date: Jun. 18, 2015

(65) Prior Publication Data

US 2016/0245275 A1 Aug. 25, 2016

Related U.S. Application Data

(60) Provisional application No. 61/915,878, filed on Dec. 13, 2013.

(51) Int. Cl.
*F04B 49/12* (2006.01)
*F04B 53/22* (2006.01)
(Continued)

(52) U.S. Cl.
CPC ..... *F04B 49/12* (2013.01); *F04B 7/06* (2013.01); *F04B 9/02* (2013.01); *F04B 53/16* (2013.01); *F04B 53/22* (2013.01)

(58) Field of Classification Search
CPC ..... F04B 49/12; F04B 53/16; F04B 17/00; F04B 53/22; F04B 9/02
See application file for complete search history.

(56) References Cited

U.S. PATENT DOCUMENTS 2,592,237 A * 4/1952 Bradley ..... F04B 1/053 74/570.21
4,941,809 A 7/1990 Pinkerton
(Continued)

*Primary Examiner* — Christopher S Bobish
(74) *Attorney, Agent, or Firm* — Hoffmann and Baron, LLP

(57) ABSTRACT

An angle adjustment mechanism for a pump and a motor includes a base, an eccentric bushing and a fixed link. The base has a motor flange for mounting a motor, a pump flange opposite the motor flange for mounting a pump, a hinge disposed between the motor flange and the pump flange and a pair of spaced apertures disposed opposite the hinge. The eccentric bushing has a body portion received in one of the apertures of the base and an inner bore with an axial center line offset from an axial center line of the body portion. The fixed link has a first pin portion received in the inner bore of the eccentric bushing and a second pin portion received in the other of the apertures of the base. With this arrangement, rotation of the eccentric bushing changes the distance between the apertures of the base, thereby changing an angle between the motor flange and the pump flange about the hinge.

13 Claims, 9 Drawing Sheets

(51) Int. Cl.

| | |
|---|---|
| ***F04B 9/02*** | (2006.01) |
| ***F04B 7/06*** | (2006.01) |
| ***F04B 53/16*** | (2006.01) |

(56) References Cited

U.S. PATENT DOCUMENTS

| | | | | |
|---|---|---|---|---|
| 4,954,046 | A | 9/1990 | Irvin et al. | |
| 5,015,157 | A | 5/1991 | Pinkerton et al. | |
| 5,020,980 | A * | 6/1991 | Pinkerton | F04B 7/06 417/426 |
| 5,246,354 | A * | 9/1993 | Pardinas | F04B 7/06 417/493 |
| 5,301,597 | A * | 4/1994 | Sauer | B60T 11/16 403/28 |
| 5,863,187 | A | 1/1999 | Bensley et al. | |
| 5,865,070 | A * | 2/1999 | Bornhorst | F16C 3/06 100/257 |
| 6,540,486 | B2 | 4/2003 | Amsler et al. | |
| 7,708,535 | B2 | 5/2010 | Peeler et al. | |
| 2006/0133890 | A1* | 6/2006 | Etoile | F16C 11/0614 403/122 |
| 2013/0300174 | A1* | 11/2013 | Ito | B60N 2/1615 297/354.1 |

* cited by examiner

MECHANISM FOR FINE ADJUSTMENT OF FLOWS IN FIXED DISPLACEMENT PUMP

CROSS-REFERENCE TO RELATED APPLICATION

This application claims the benefit of U.S. Provisional Application No. 61/915,878, filed Dec. 13, 2013, which is incorporated herein by reference in its entirety for all purposes.

BACKGROUND

A family of valveless pumps, which have at their heart special mounting means, commonly referred to as a base, interposed between a drive motor and a pump head, is known in the art. These bases are typically injection molded plastic and incorporate a living hinge separating an upper portion from a lower portion. The upper portion of the base can be tilted with respect to the lower portion by flexure of the living hinge. The relative angle between the upper and lower portions establishes the pump output volume per revolution. This entire mechanism has been described previously in commonly owned U.S. Pat. Nos. 5,020,980 and 4,941,809.

Conventionally, the method for adjustment and setting of the angle has been accomplished by means of adjusting screw engagement with pivot pins in the two portions of the base, which are positioned on the opposite side of the central axis of the base. Certain applications require pumps with the same target output per revolution. This has been accomplished by substituting fixed linkage means for the adjustable screw and pivot pins. The fixed links are injection molded from plastic resin and the tooling used to mold these links allows for different lengths to be produced such that different target pump displacements can be routinely produced.

The original intention for embracing the fixed link arrangement over the adjustable screw arrangement was to reduce cost. That has been demonstrated to have been accomplished, but there are significant additional advantages to the fixed link concept: 1) Far better mechanical stability due to absence of backlash problems; 2) Improved displacement volume stability in the presence of varying ambient temperatures; and 3) Overall stiffness of the base assembly with the fixed links is far better than that of the adjusting screw version.

The improvements with respect to temperature differentials is due to the fact that the plastic links expand and contract in unison with the plastic base such that the angle does not change. The wide difference in thermal coefficients of expansion between the stainless-steel adjusting screw and the plastic base are such that changes in ambient temperature yield significant changes in angle.

Despite the advantages of the fixed link concept, there has been one drawback preventing its wider use in more applications. This drawback is the fact that there is no means for fine adjustment for precise calibration of displacement once the parts have been assembled. There are numerous applications where merely getting close to a target displacement for hundreds or thousands of pumps is not sufficient. Such applications need each and every pump to be individually "tweaked" to arrive at a precise output. Such accuracy must routinely achieve ±1% of the target value. Due to the variations in other components plus slight differences in molded lengths of fixed links, accuracy is generally not better than ±6% of target value.

Accordingly, it would be desirable to provide a means for dealing with the need for slight adjustments to output volume when the fixed link construction is employed.

SUMMARY

In one aspect of the present disclosure, an angle adjustment mechanism for a pump and a motor is provided. The mechanism generally includes a base, an eccentric bushing and a fixed link. The base has a motor flange for mounting a motor, a pump flange opposite the motor flange for mounting a pump, a hinge disposed between the motor flange and the pump flange and a pair of spaced apertures disposed opposite the hinge. The eccentric bushing has a body portion received in one of the apertures of the base and an inner bore with an axial center line offset from an axial center line of the body portion. The fixed link has a first pin portion received in the inner bore of the eccentric bushing and a second pin portion received in the other of the apertures of the base. With this arrangement, rotation of the eccentric bushing changes the distance between the apertures of the base, thereby changing an angle between the motor flange and the pump flange about the hinge.

In a preferred embodiment, the eccentric bushing includes a head portion terminating one end of the body portion for facilitating rotation of the eccentric bushing. The head portion is preferably hexagonal shaped and further preferably includes a notch located at a distance furthest from the center line of the inner bore.

The hinge of the base is preferably a living hinge formed integral with the base.

The fixed link preferably includes a pair of complimentary segments. Each segment has an insertion pin portion and a receptacle pin portion, wherein the insertion pin portion of each segment is received in the receptacle portion of the other segment.

In another aspect of the present disclosure, a motor and pump assembly is provided, wherein a motor is mounted to the motor flange of the base and a pump is mounted to the pump flange of the base. The motor has a shaft rotatable about a rotation axis and the pump has a piston rotatable about a rotation axis and linearly translatable along the rotation axis, wherein the pump piston is coupled to the motor shaft. Rotation of the eccentric bushing changes the distance between the apertures of the base thereby changing an angle between the rotation axis of the motor shaft and the rotation axis of the pump piston about the hinge.

In another aspect of the present disclosure, a method for adjusting the angular orientation between a motor shaft of a motor and a pump piston of a pump is provided. According to the method, a base as described above is provided between the motor and the pump, and the eccentric bushing is rotated within one of the spaced apertures to change an angle between the motor shaft and the pump piston about the hinge.

Thus, an adjustment mechanism is provided, which employs a special bushing having an outer cylindrical diameter for close engagement in an enlarged hole in the lower half of the base. This hole has previously been used to engage a pivot pin for the screw adjustment mechanism and alternatively a round boss on the fixed link. In this aspect of the invention, this hole is enlarged from ¼" to 5/16" to receive the aforementioned bushing. The bushing is provided with a ¼" through hole with its axis parallel to its outer diameter but offset by approximately 0.02". At one end of the bushing is provided a hexagonal flange for engagement of a wrench. Additionally the bushing is provided with a notch to indicate the maximum offset location which is useful in the final calibration "tweaking" of the pump.

The eccentric bushing is assembled into the enlarged hole in the base and the fixed links are assembled into the upper base pivot pin hole and the central offset bore of the eccentric bushing. At final calibration a thin pattern wrench is used to turn the eccentric bushing which causes the lower boss of the plastic link to move either closer to or farther away from its engagement point with the upper portion of the base. The eccentricity of the lower bushing allows for approximately ±10% adjustment in pump output. By this means, extremely precise calibration can be achieved with fixed link pumps. Such pumps can thereby benefit from the excellent advantages of fixed links enumerated above while still achieving the required precision.

Features of the disclosure will become apparent from the following detailed description considered in conjunction with the accompanying drawings. It is to be understood, however, that the drawings are designed as an illustration only and not as a definition of the limits of this disclosure.

DETAILED DESCRIPTION

Figure 1:
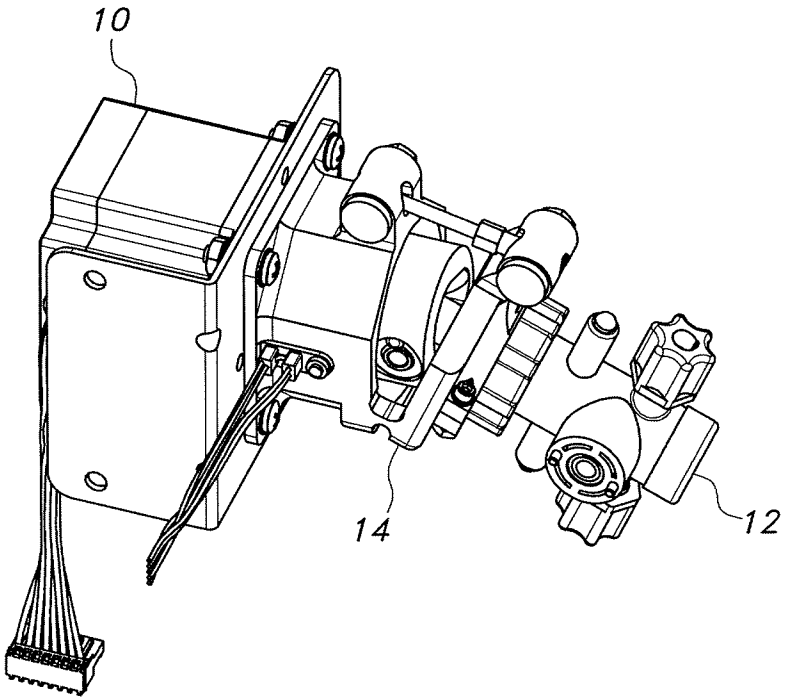
FIG. 1 (PRIOR ART)
FIG. 1 is a perspective view of a conventional motor/pump connection utilizing adjustable flow angle hardware, according to the prior art.

FIG. 1 shows a conventional motor 10 connected to a pump 12 via a base 14. The motor 10 has a shaft that rotates about a rotational axis and the pump has a piston that also rotates about a rotational axis and also translates in the direction of the rotational axis. The shaft of the motor is coupled to the piston of the pump so that rotation of the motor shaft will cause rotation of the pump piston. Also, by tilting the rotational axis of the pump piston with respect to the rotational axis of the motor shaft, rotation of the motor shaft will also cause linear translation of the pump piston in a manner as described in further detail below. A pump and motor support arrangement of this type is shown and described in commonly owned U.S. Pat. Nos. 4,941,809 and 5,020,980, the specifications of which are incorporated herein by reference in their entirety for all purposes.

Such pump and motor arrangement operates as follow. The motor shaft of the motor 10 is coupled to a piston of the pump 12. Each rotation of the motor shaft rotates the piston of the pump. Due to the angular orientation between the pump and the motor, each rotation of the motor shaft further causes the pump piston to reciprocate in the axial direction to alternately draw in and push out fluid so as to transfer fluid between an inlet and an outlet of the pump. The amplitude of the piston stroke determines the volume of the fluid delivered between the inlet and the outlet of the pump. By varying the angle of the pump with respect to the motor, the stroke of the piston is adjusted, thereby adjusting the volume of the fluid transferred between the inlet and the outlet.

In such prior art pump and motor arrangements, the angle of the pump 12 with respect to the motor 10 is adjustable via the base 14 to provide a desired volumetric flow of the pump with each rotation of the motor shaft of the motor. Therefore, it is desirable to provide a base 14 which is adapted for adjusting the angles between the axis of the pump and the motor shaft of the motor.

FIG. 1 shows one prior art embodiment of an adjustable base 14, which includes a flange to which the motor 10 is mounted and an opposite flange to which the pump 12 is mounted. Between the two flanges is a flexible living hinge, which allows angular pivoting of the flanges with respect to the hinge. Opposite the hinge are two bosses, between which adjustable flow angle hardware is provided. In the embodiment shown in FIG. 1, the adjustable flow angle hardware is in the form of a screw and nut arrangement connected between pivot pins inserted in the respective bosses of the base. Rotation of the nut with respect to the screw selectively lengthens or shortens the length between the pivot pins of the bosses, thereby adjusting the angle of the motor flange with respect to the pump flange.

However, some of the disadvantages of such arrangement include problems with thermal expansion of the differing materials depending on the work environment. The adjustable screw arrangement is also less stable and is prone to loosening, wherein the angle will be undesirably altered. This arrangement also involves numerous components making assembly complex, and resulting in increased cost.

Figure 2:
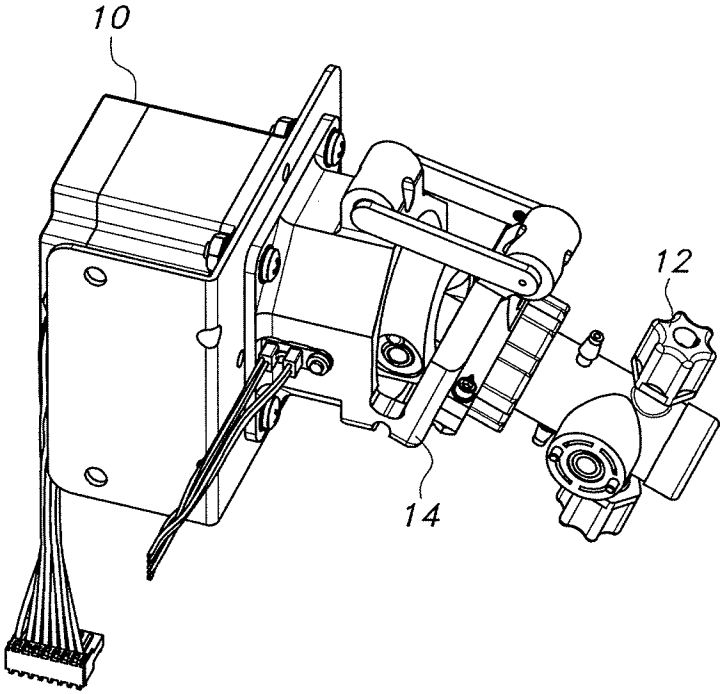
FIG. 2 (PRIOR ART)
FIG. 2 is a perspective view of a conventional motor/pump connection utilizing a fixed link, according to the prior art.

FIG. 2 shows an alternative embodiment of a motor/pump connection of the prior art utilizing a base, similar to the base shown in FIG. 1, but utilizing a fixed link provided between the opposing bosses. Specifically, the base 14 shown in FIG. 2, again includes a motor mounting flange and a pump mounting flange on opposite sides of a flexible living hinge. Opposite the hinge are opposed bosses between which a fixed link is provided to set the angle between the pump and the motor. The length of the fixed link is selected based on the desired volumetric flow produced by the pump. In certain applications, a variety of fixed links of differing lengths can be provided to adjust the volume of the pump in a predetermined range.

Figure 3:
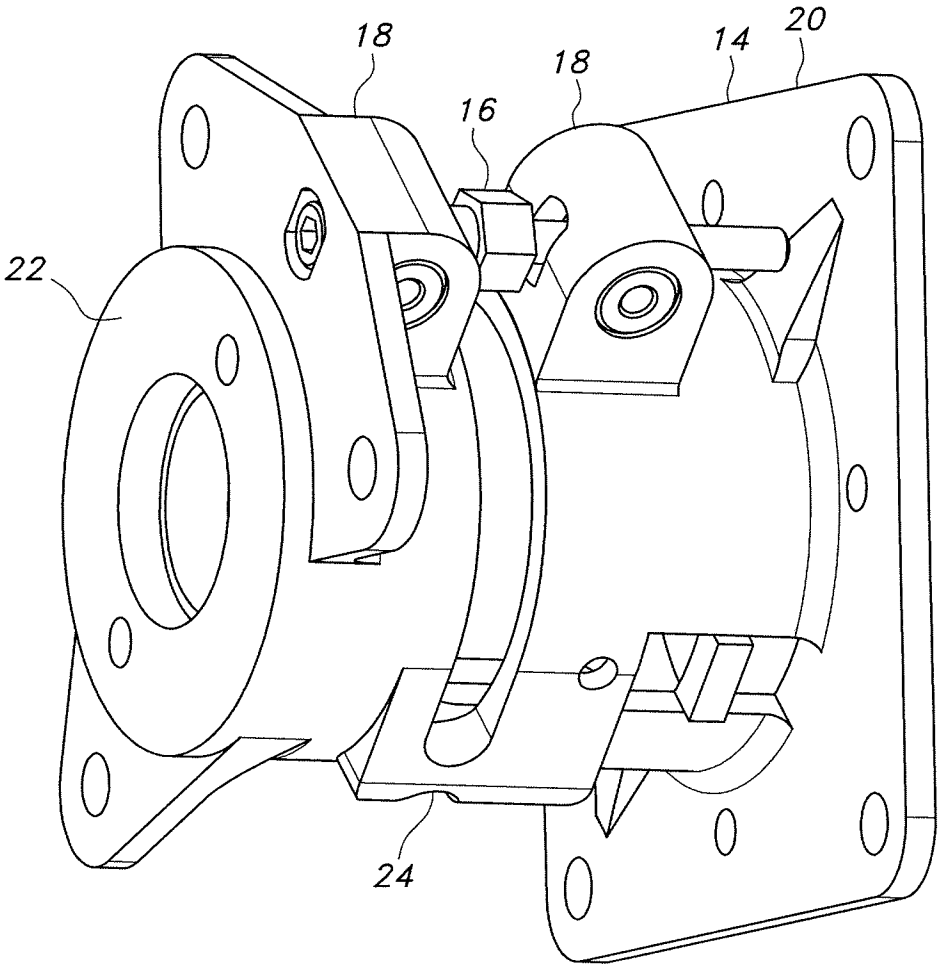
FIG. 3 (PRIOR ART)
FIG. 3 is an isolated view of the base of a conventional motor/pump base utilizing adjustable flow angle hardware, according to the prior art.

FIG. 3 shows in further detail an adjustable screw and nut arrangement, similar to that shown in FIG. 1. It can be seen in FIG. 3 how rotation of the nut 16 with respect to the screw will either lengthen or shorten the distance between the pivot pins provided within the respective bosses 18. Lengthening or shortening of the distance between the bosses 18 will, in turn, change the angle between the motor mounting flange 20 and the pump mounting flange 22 due to the resultant bending of the flexible hinge 24.

Figure 4:
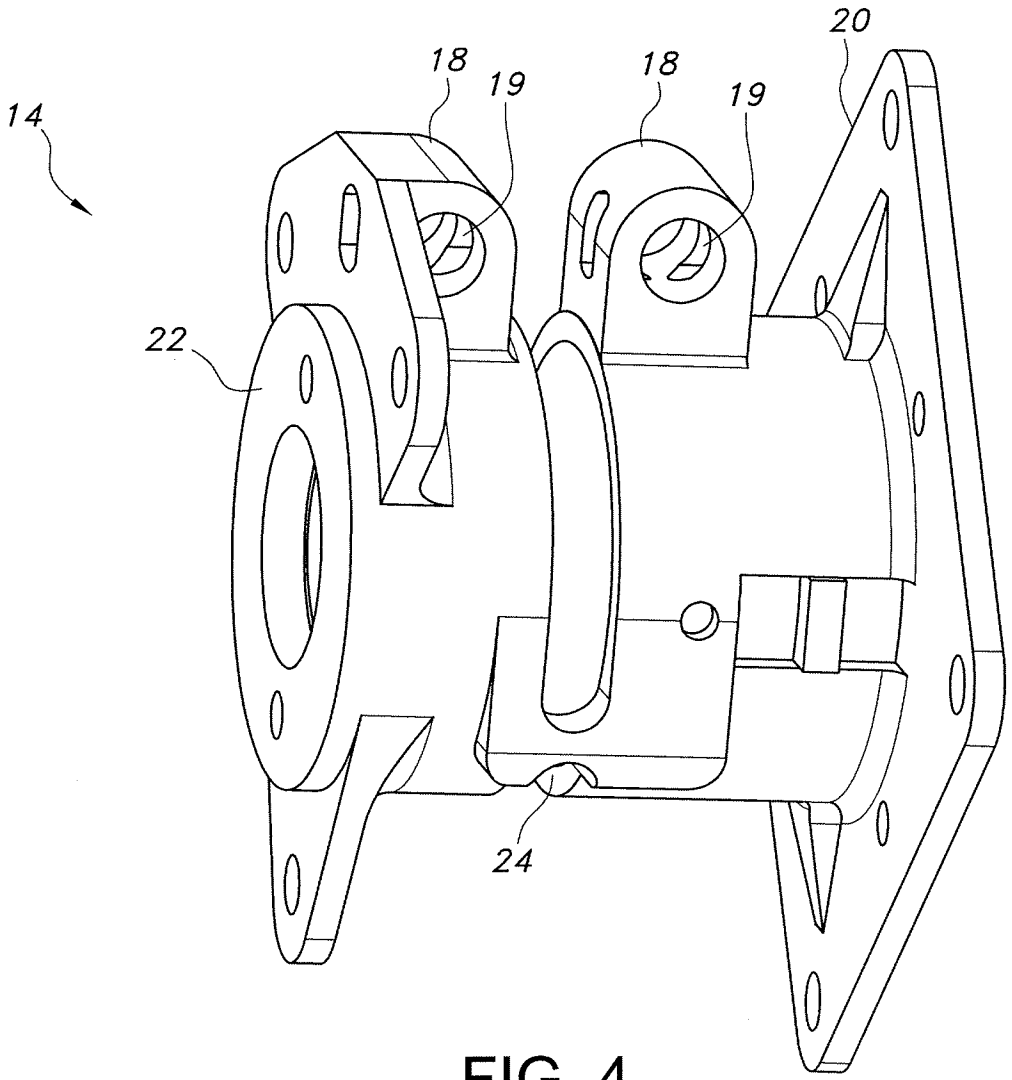
FIG. 4 (PRIOR ART)
FIG. 4 is an isolated perspective view of the base alone, according to the prior art.

FIG. 4 shows a base 14 of the prior art without the adjustment mechanism. It can be appreciated how the base 14 shown in FIG. 4 might be used in either of the two prior art embodiments described above, and can further be used with the present invention, as will be discussed in further detail below. The base 14 includes a motor mounting flange 20, the bosses 18 having apertures 19 formed therein, a pump mounting flange 22 and a living hinge 24 provided opposite the bosses.

Figure 5:
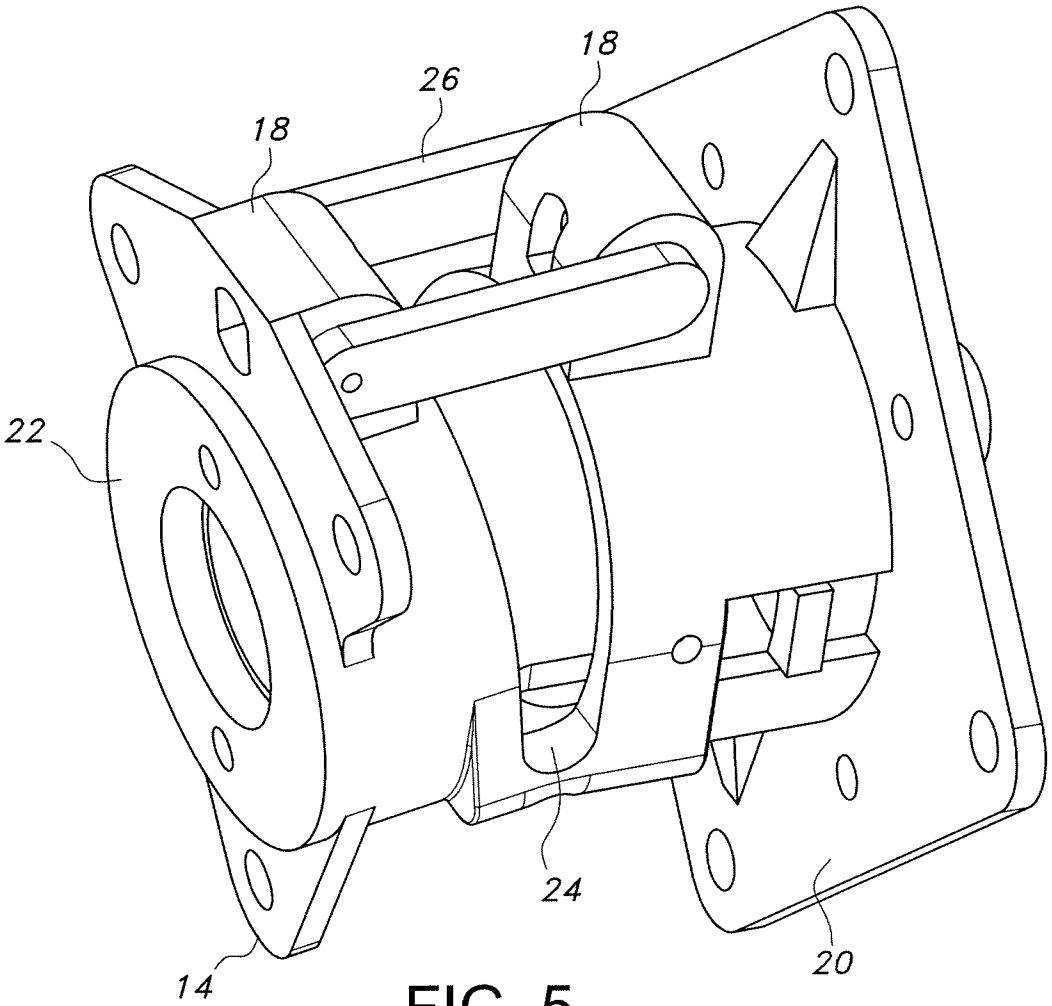
FIG. 5 (PRIOR ART)
FIG. 5 is an isolated perspective view of the base utilizing a fixed link, according to the prior art.

FIG. 5 shows a base 14 of the prior art, as described above, and further including a fixed link 26 for setting the distance between the bosses 18 thereby setting the angle between the motor flange 20 and the pump flange 22 with respect to the living hinge 24.

Figure 6:
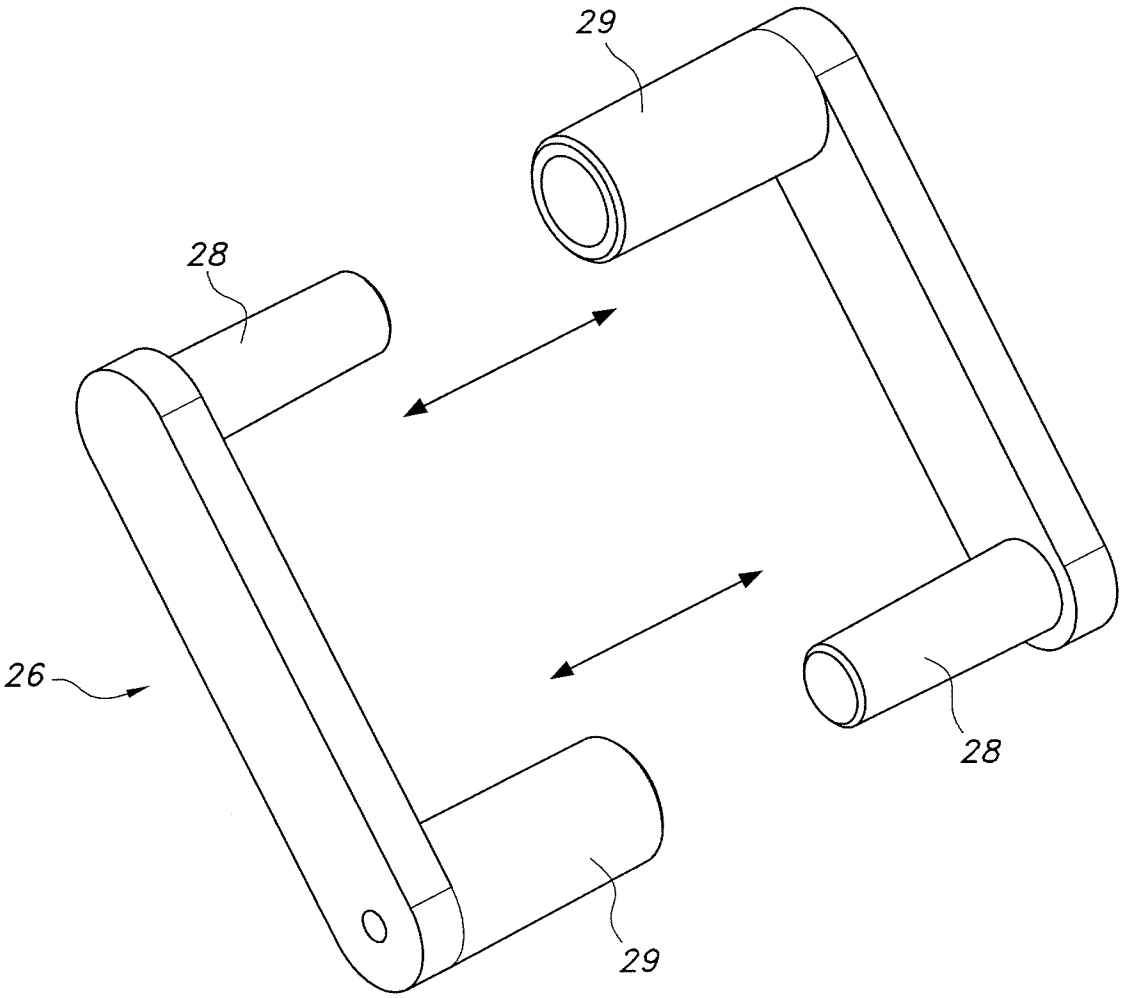
FIG. 6 (PRIOR ART)
FIG. 6 is an isolated perspective view of two components of a fixed link of the prior art.

As shown in more detail in FIG. 6, the link 26 preferably includes a pair of injection molded complimentary segments, wherein each link segment includes an insertion pin portion 28 received within a matching sized pin receptacle portion 29 of the opposite link segment. The pin receptacle portions 29 of each link are sized to be interference fit within a correspondingly sized hole in a respective boss 18 of the base 14. Again, the length between the pin portion 28 and the pin receptacle portion 29 of each link 26 determines the angle between the pump and the motor.

Thus, a variety of fixed links 26 having different lengths can be provided with the base 14 shown in FIG. 5 for setting varying lengths between the bosses 14. The differing lengths will cause the hinge 24 to pivot about its pivot point at different angles, so that a desired pump to motor angle can bet set.

The benefits with the fixed linked systems shown in FIGS. 2, 5 and 6, include increased stability of the base with less sensitivity to thermal expansion. However, due to tolerances in injection molding and tolerances between the pump and the motor themselves, an exact desired volume flow rate is not always achieved despite a proper selection of the link length. Thus, it would be desirable to have all of the benefits of a fixed link, with the added benefit of adjustment of the length of the fixed link.

Figure 7:
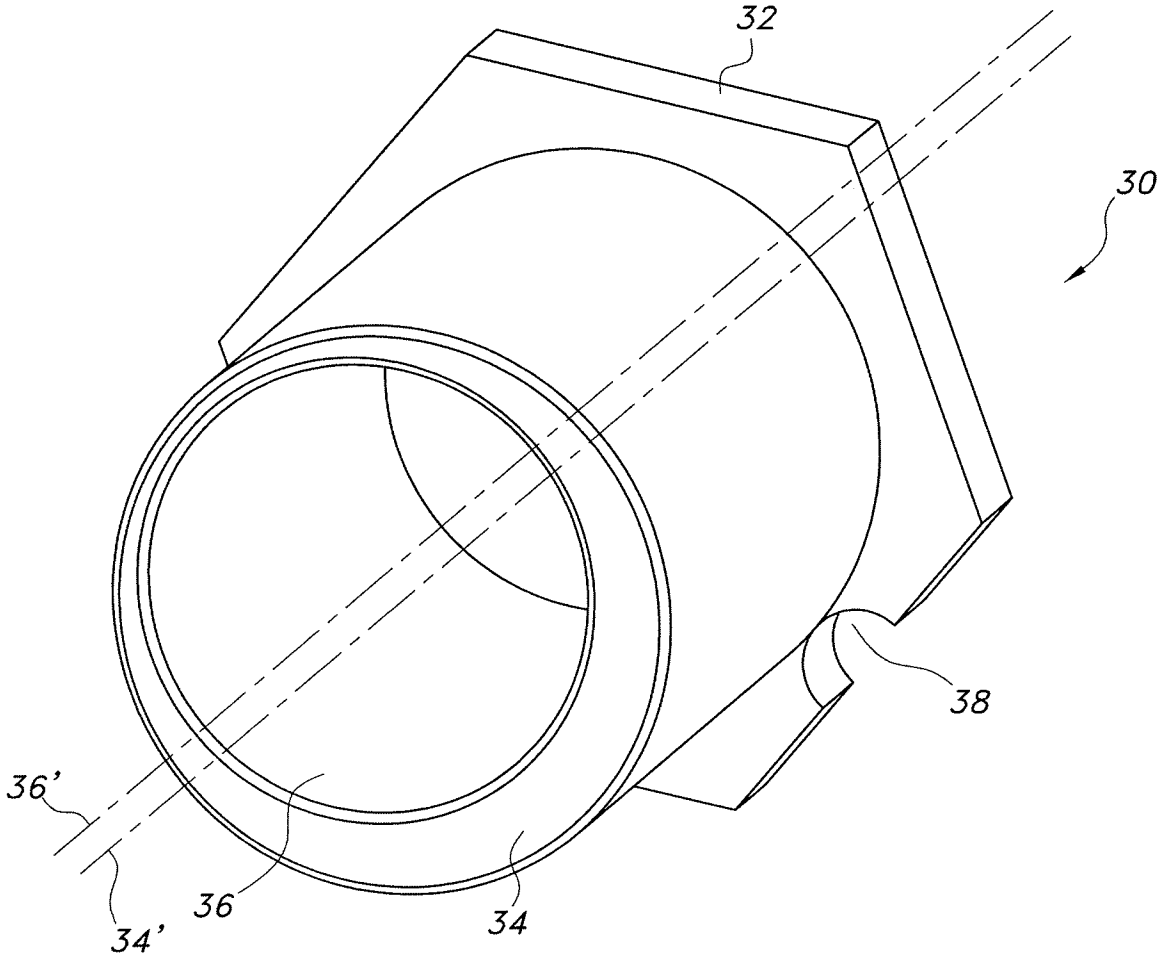
FIG. 7 is a perspective view of an eccentric bushing formed in accordance with the present invention.
Figure 8:
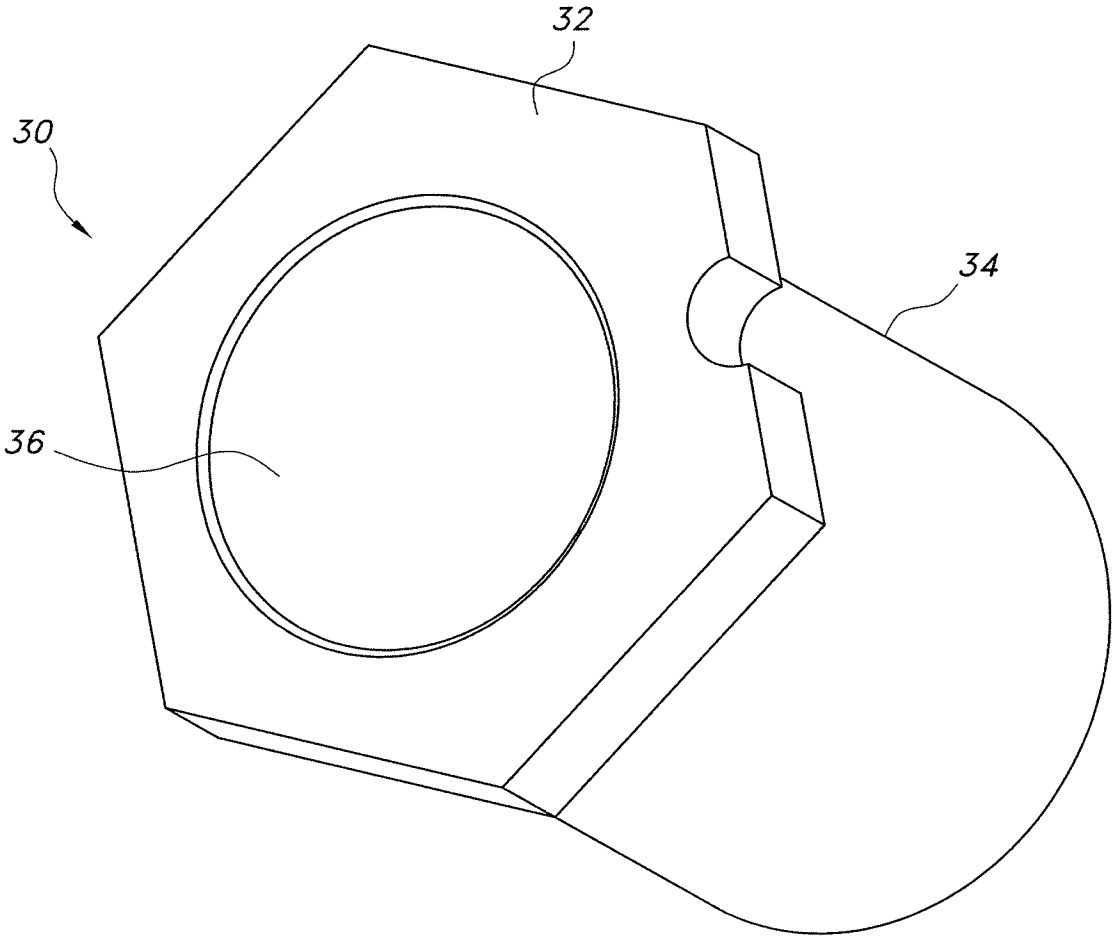
FIG. 8 is a rear perspective view of the eccentric bushing shown in FIG. 7.

Accordingly, the present invention provides a fixed link arrangement with adjustability of the length between the apertures 19 of the respective bosses 18 of the base 14. This is achieved by providing an eccentric bushing 30, as shown in FIGS. 7 and 8, received within one or both of the apertures 19 of the base bosses 18.

The eccentric bushing 30 of the present invention includes a head portion 32 and a body portion 34 extending in coaxial relation with the head portion. The head portion 32 is preferably hexagonal shaped for purposes which will be described later. The body portion 34 is preferably cylindrically shaped and has an outer diameter sized to be interference fit within at least one of the through holes 19 provided in the bosses 18 of the base 14. The length of the body portion 34 is also preferably selected to match the length of the through hole 19 provided in the respective boss 18 of the base.

Formed axially in the body portion 34 and the head portion 32 is a bore 36 extending the length of the bushing 30. The bore 36 has an axial center line 36' off set from the axial center line 34' of the body portion 34. In other words, the center line 36' of the bore 36 is not coaxial with the center line 34' of the body portion 34. Thus, the bushing 30 has an axial through hole 36 formed in an eccentric relation with the outer diameter of the body portion 34 so that rotation of the body portion about its axial center line 34' will cause the axial centerline 36' to revolve around the axial center line 34' of the body portion.

Figure 9:
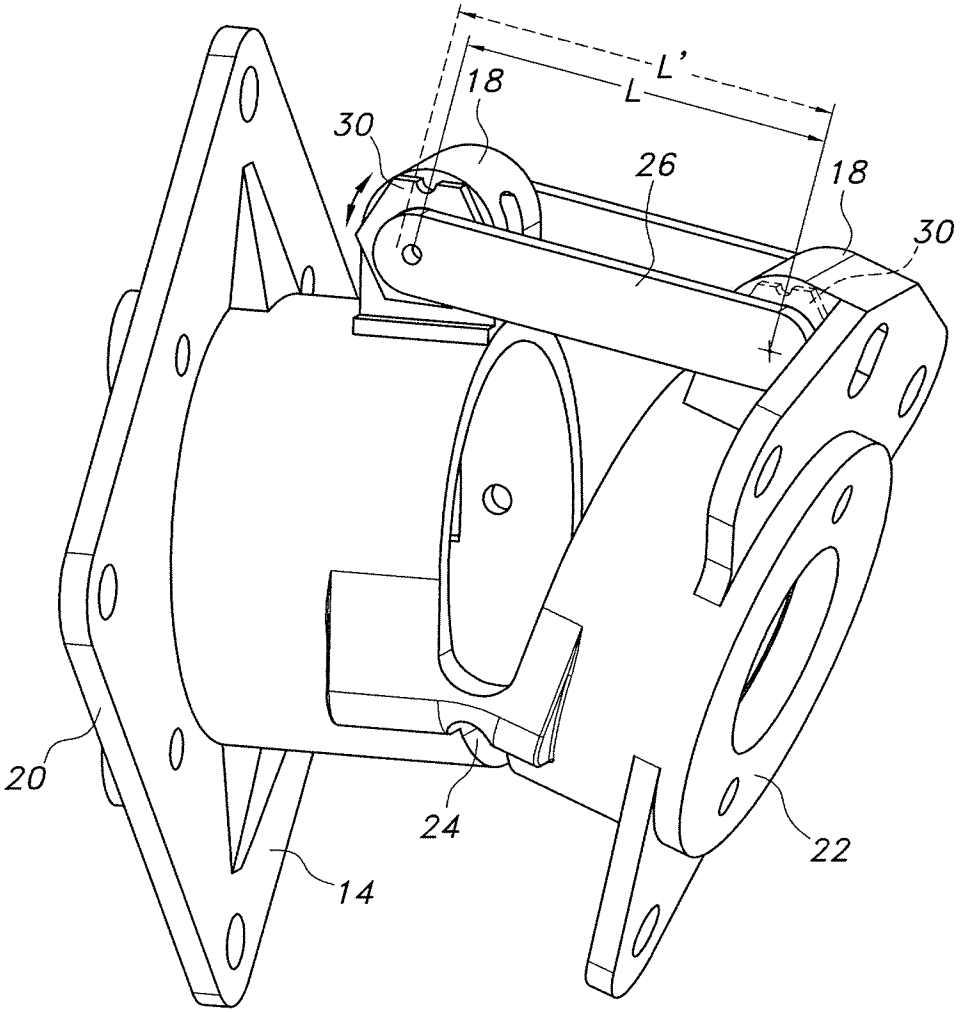
FIG. 9 a perspective view of the motor/pump base formed in accordance with the present invention.
Figure 10:
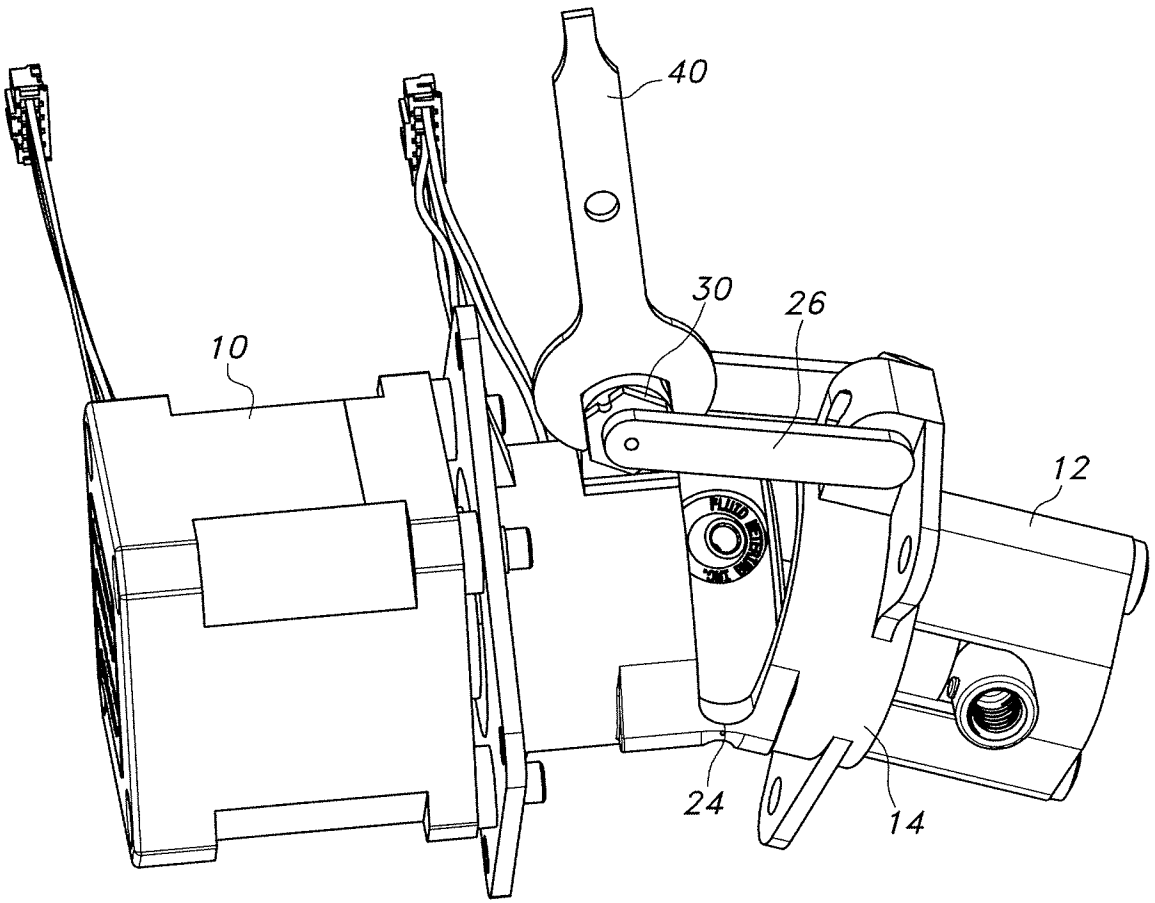
FIG. 10 is a perspective view of the motor/pump base formed in accordance with the present invention attached to a motor and a pump, wherein the displacement length is being adjusted by a wrench.

The eccentric axial through hole 36 has an inner diameter sized to receive one of the pin receptacle portions 29 of the fixed link 26, (shown in FIG. 6), in an interference or a press fit relationship. Thus, as shown in FIGS. 9 and 10, with the eccentric bushing 30 inserted in a through hole 19 of the boss 18 it can be seen how rotation of the bushing 30 with respect to the boss 18 will change the location of the inner bore 36 of the bushing with respect to the through hole 19 of the boss 18. By changing the axial location of the receptacle pin portion 29 of the fixed link 26, it can be appreciated how the distance between the opposite bosses 18 of the base 14 can effectively change by virtue of the fixed link.

Specifically, rotation of the bushing 30 within the aperture 19 of the boss 18 will cause the axial center line 36' of the inner bore 36 to change its position. However, because the length of the fixed link 26 is fixed, rotation of the eccentric bushing will have a cam effect on the boss 18 in which it is received, thereby causing the spacing between the apertures of the bosses to change from L to L', as shown in FIG. 9. By changing this distance, the hinge 24 is forced to flex open or closed to thereby change the angular orientation between the pump flange 22 and the motor flange 20.

The hexagonal shape of the head 32 of the bushing 30 also facilitates application of a wrench 40 to aid in rotation of the bushing 30. The head portion 32 of the bushing 30 is also preferably provided with a notch 38 so as to provide a visual indication of the maximum displacement of the through hole 36 with respect to the body portion 34. Thus, the notch 38 is preferably provided on the head portion 32 at a location that is furthest from the center line 36' of the inner bore 36.

It is also possible to provide an eccentric bushing in each of the apertures 19 of the bosses 18 to thereby even greater adjustability.

While various embodiments of the present invention are specifically illustrated and/or described herein, it will be appreciated that modifications and variations of the present invention may be effected by those skilled in the art without departing from the spirit and intended scope of the invention.

What is claimed is:

1. An angle adjustment mechanism for a pump and a motor comprising:

a base including a motor flange for mounting a motor, a pump flange opposite said motor flange for mounting a pump, a hinge disposed between said motor flange and said pump flange and a pair of spaced apertures disposed on opposite sides of said hinge;

an eccentric bushing having a body portion rotatably secured within one of said apertures of said base, said eccentric bushing having an inner bore with an axial center line offset from an axial center line of said body portion; and a fixed length link having a first end with a first pin portion rotatably received in said inner bore of said eccentric bushing and having a second end with a second pin portion received in the other of said apertures of said base, wherein rotation of said eccentric bushing with respect to said first pin portion and said base changes the distance between said apertures of said base, thereby changing a set angle between said motor flange and said pump flange about said hinge; and wherein the eccentric bushing maintains its angular position with respect to the base upon the rotation of the first pin portion, and the fixed length link first and second ends and the eccentric bushing remain positionally fixed during operation of the pump, and the motor flange and the pump flange do not move relative to each other during operation of the pump.

2. An angle adjustment mechanism as defined in claim 1, wherein said eccentric bushing comprises a head portion terminating one end of said body portion, said head portion having a circumferential shape adapted for facilitating rotation of said eccentric bushing.

3. An angle adjustment mechanism as defined in claim 2, wherein said circumferential shape of said head portion is hexagonal shaped for application of a wrench.

4. An angle adjustment mechanism as defined in claim 2, wherein said head portion comprises a notch formed in an outer radial surface of said circumferential shape, said notch being located at a distance furthest from said center line of said inner bore.

5. An angle adjustment mechanism as defined in claim 1, wherein said hinge of said base is a living hinge formed integral with said base.

6. An angle adjustment mechanism as defined in claim 1, wherein the eccentric bushing body portion is interference fit within one of said apertures of said base, the interference fit of the eccentric bushing in the base permits rotation of said eccentric bushing with respect to said first pin portion and said base and permits the eccentric bushing to maintain its angular position.

7. An angle adjustment mechanism as defined in claim 1, wherein said fixed link comprises a pair of complimentary segments, each segment including an insertion pin portion and a receptacle pin portion, the insertion pin portion of each segment being received in the receptacle portion of the other segment to form the first and second pin portions respectively.

8. A motor and pump assembly comprising:

a base including a motor flange, a pump flange opposite said motor flange, a hinge disposed between said motor flange and said pump flange and a pair of spaced apertures disposed on opposite sides of said hinge;

a motor mounted to said motor flange of said base, said motor having a shaft rotatable about a rotation axis;

a pump mounted to said pump flange of said base, said pump haying a piston rotatable about a rotation axis and linearly translatable along the rotation axis, said pump piston being coupled to said motor shaft;

an eccentric bushing having a body portion interference fit within one of said apertures of said base, said eccentric bushing having an inner bore with an axial center line offset from an axial center line of said body portion; and a fixed length link having a first end with a first pin portion rotatably received in said inner bore of said eccentric bushing and having a second end with a second pin portion received in the other of said apertures of said base, wherein rotation of said eccentric bushing with respect to said first pin portion and said base changes the distance between said apertures of said base thereby changing a set angle between said rotation axis of said motor shaft and said rotation axis of said pump piston about said hinge; and wherein the eccentric bushing maintains its angular position with respect to the base upon the rotation of the first pin portion, and the fixed length link first and second ends remain positionally fixed during operation of the pump, and said motor flange and said pump flange do not move relative to each other during operation of the pump.

9. A motor and pump assembly as defined in claim 8, wherein said eccentric bushing comprises a head portion terminating one end of said body portion, said head portion radially extending beyond the body portion and having a circumferential shape adapted for facilitating rotation of said eccentric bushing.

10. A motor and pump assembly as defined in claim 9, wherein said circumferential shape of said head portion is hexagonal shaped for application of a wrench.

11. A motor and pump assembly as defined in claim 9, wherein said head portion comprises a rotational position indicator formed in an outer radial surface of said circumferential shape.

12. A motor and pump assembly as defined in claim 8, wherein said hinge of said base is a living hinge formed integral with said base.

13. A motor and pump assembly as defined in claim 8, wherein said fixed link comprises a pair of complimentary segments, each segment including an insertion pin portion and a receptacle pin portion, the insertion pin portion of each segment being received in the receptacle portion of the other segment to form the first and second pin portions respectively.

* * * * *